US008653970B2

(12) United States Patent
Hazzani

(10) Patent No.: US 8,653,970 B2
(45) Date of Patent: Feb. 18, 2014

(54) SYSTEM AND METHOD FOR BOARDING AREA SECURITY

(75) Inventor: Gideon Hazzani, Rishon Le Zion (IL)

(73) Assignee: Verint Systems, Ltd., Herzelia (IL)

( * ) Notice: Subject to any disclaimer, the term of this patent is extended or adjusted under 35 U.S.C. 154(b) by 636 days.

(21) Appl. No.: 12/539,640

(22) Filed: Aug. 12, 2009

(65) Prior Publication Data

US 2010/0039259 A1 Feb. 18, 2010

(30) Foreign Application Priority Data

Aug. 13, 2008 (IL) ..... 193440

(51) Int. Cl.
*G08B 13/00* (2006.01)

(52) U.S. Cl.
USPC ..... 340/541; 340/10.1; 340/10.2; 340/10.3; 340/10.31; 340/10.32; 340/10.33; 340/10.34; 340/10.4; 340/10.41; 340/10.42; 340/10.5; 340/10.51; 340/10.52; 340/10.6; 235/375; 235/376; 235/377; 235/378; 235/379; 235/380; 235/381; 235/382; 235/382.5; 235/383; 235/384; 235/385

(58) Field of Classification Search
USPC ..... 340/541, 10.1–10.6, 572.1–572.9; 235/375–385
See application file for complete search history.

(56) References Cited

U.S. PATENT DOCUMENTS 5,793,639 A * 8/1998 Yamazaki ..... 700/226
5,866,888 A * 2/1999 Bravman et al. ..... 235/375
6,222,452 B1 * 4/2001 Ahlstrom et al. ..... 340/572.1
6,594,547 B2 * 7/2003 Manabe et al. ..... 700/227
6,970,088 B2 * 11/2005 Kovach ..... 340/572.1
7,030,760 B1 * 4/2006 Brown ..... 340/568.1
7,327,262 B2 * 2/2008 Motteram et al. ..... 340/572.1
7,339,523 B2 * 3/2008 Bye ..... 342/451
7,737,861 B2 * 6/2010 Lea et al. ..... 340/8.1
8,131,592 B2 * 3/2012 Gordon ..... 705/14.4
8,238,915 B2 * 8/2012 Hazzani ..... 455/436
2001/0032034 A1 * 10/2001 Manabe et al. ..... 700/225

(Continued)

FOREIGN PATENT DOCUMENTS

WO 2010116292 A2 10/2010
WO WO 2010116292 A2 * 10/2010 ..... H04W 24/06

OTHER PUBLICATIONS

3GPP TS 24.008 v3.8.0, "3rd Generation Partnership Project; Technical Specification Group Core Network; Mobile radio interface layer 3 specification; Core Network Protocols—Stage 3," Release 1999, (Jun. 2001), 442 pages.

(Continued)

*Primary Examiner* — George Bugg
*Assistant Examiner* — Paul Obiniyi
(74) *Attorney, Agent, or Firm* — Meunier Carlin & Curfman

(57) ABSTRACT

A security method that includes defining rules specifying permitted movements of passengers in a transportation terminal. Passengers entering the terminal may be issued a boarding pass having a Radio Frequency Identification (RFID) tag attached thereto. The location of the RFID tag may be measured and responsive to the measured location of the RFID tag, a violation of at least one of the rules by the passenger may be detected. An action with respect to the detected violation may be taken. The rules may define a region that is forbidden for access, a region in which the passengers are expected to be in motion, a region in which the passengers are expected not to be stationary for more than a given time period, etc.

18 Claims, 3 Drawing Sheets

(56) References Cited

U.S. PATENT DOCUMENTS

| | | | | |
|---|---|---|---|---|
| 2002/0077080 | A1* | 6/2002 | Greene | 455/412 |
| 2003/0035144 | A1* | 2/2003 | Shima | 358/1.18 |
| 2004/0124982 | A1* | 7/2004 | Kovach | 340/572.1 |
| 2005/0256724 | A1* | 11/2005 | Rasin et al. | 705/1 |
| 2006/0080819 | A1* | 4/2006 | McAllister | 29/403.3 |
| 2006/0119888 | A1* | 6/2006 | Shima | 358/1.15 |
| 2006/0145852 | A1* | 7/2006 | McElhannon et al. | 340/572.1 |
| 2007/0126634 | A1* | 6/2007 | Bye | 342/451 |
| 2008/0220720 | A1* | 9/2008 | Ashley et al. | 455/41.2 |
| 2008/0309492 | A1* | 12/2008 | Mihoubi | 340/572.1 |
| 2009/0008439 | A1* | 1/2009 | Kubler et al. | 235/375 |
| 2009/0040101 | A1* | 2/2009 | Ani et al. | 342/357.07 |
| 2009/0153307 | A1* | 6/2009 | Kim et al. | 340/10.41 |
| 2009/0276089 | A1* | 11/2009 | Bartholomew | 700/235 |
| 2009/0315704 | A1* | 12/2009 | Rosing et al. | 340/539.13 |
| 2010/0157049 | A1* | 6/2010 | Dvir et al. | 348/143 |

OTHER PUBLICATIONS

Asokan, N., et al., "Man-in-the-Middle in Tunneled Authentication Protocols," Draft version 1.3 (latest public version: http://eprint.iacr.org/2002/163/, Nov. 11, 2002, 15 pages.

Vedaldi, Andrea, "An implementation of SIFT detector and descriptor," University of California at Los Angeles, 7 pages, 2008.

Girardin, Fabien, et al., "Detecting air travel to survey passengers on a worldwide scale," Journal of Location Based Services, 26 pages, 2008.

Meyer, Ulrike, et al., "On the Impact of GSM Encryption and Man-in-the-Middle Attacks on the Security of Interoperating GSM/UMTS Networks," IEEE, 2004, 8 pages.

* cited by examiner

SYSTEM AND METHOD FOR BOARDING AREA SECURITY

FIELD OF THE DISCLOSURE

The present disclosure relates generally to security systems, and particularly to methods and systems for tracking passengers and baggage.

BACKGROUND OF THE DISCLOSURE

Radio Frequency Identification (RFID) technology is used in a wide variety of identification and tracking applications, such as inventory control, product tracking, automatic toll collection, and book tracking in libraries. In a typical application, RFID transponders (tags) are attached to tracked objects. Each tag stores an identifier indicative of the respective tracked object, and may also store data related to the object. RFID transceivers communicate with the tags in order to remotely track and/or read the data related to the tracked objects.

SUMMARY OF THE DISCLOSURE

An embodiment that is described herein provides a security method, including:

defining one or more rules specifying permitted movements of passengers in a transportation terminal;

issuing to a passenger entering the terminal a boarding pass having a Radio Frequency Identification (RFID) tag attached thereto;

measuring a location of the RFID tag;

responsively to the measured location of the RFID tag, detecting a violation of at least one of the rules performed by the passenger; and invoking an action with respect to the detected violation.

In some embodiments, at least one of the rules specifies a region that is forbidden for access, and detecting the violation includes detecting that the passenger is located in the specified region. Additionally or alternatively, at least one of the rules specifies a region in which the passengers are expected to be in motion, and detecting the violation includes detecting that the passenger is located in the specified region but is not in motion. Further additionally or alternatively, at least one of the rules specifies a region in which the passengers are expected not to be stationary for more than a given time period, and detecting the violation includes detecting that the passenger is stationary in the specified region for longer than the given time period.

In a disclosed embodiment, the transportation terminal includes at least first and second separate terminals, issuing the boarding pass includes issuing the boarding pass at the first terminal, and measuring the location includes measuring the location of the RFID tag at the second terminal.

In some embodiments, invoking the action includes issuing an alert. In an embodiment, issuing the boarding pass includes uploading information regarding the passenger into the RFID tag, measuring the location includes extracting the uploaded information from the RFID tag, and issuing the alert includes reporting at least part of the extracted information in the alert. In another embodiment, issuing the alert includes providing the alert to a monitoring center. Additionally or alternatively, issuing the alert includes transmitting the alert to a wireless communication terminal.

In yet another embodiment, issuing the boarding pass includes attaching another RFID tag to a luggage item that is admitted by the passenger into the terminal, measuring the location includes measuring a first location of the RFID tag and a second location of the other RFID tag, and detecting the violation includes detecting a mismatch between the first and second locations.

There is additionally provided, in accordance with an embodiment that is described herein, a security method, including:

defining a rule specifying permitted movements of luggage items in a transportation terminal;

attaching a Radio Frequency Identification (RFID) tag to a luggage item that is admitted by a passenger into the terminal;

measuring a location of the RFID tag;

responsively to the measured location of the RFID tag, detecting a violation of the rule by the luggage item; and invoking an action with respect to the detected violation.

In some embodiments, at least one of the rules specifies a region in which the luggage items are expected not to be stationary for more than a given time period, and detecting the violation includes detecting that the luggage item is stationary in the specified region for longer than the given time period. In an embodiment, a given rule specifies permitted relations between the movements of multiple luggage items, attaching the RFID tag includes attaching two or more RFID tags to respective luggage items admitted into the terminal, measuring the location includes measuring respective locations of the RFID tags, and detecting the violation includes detecting the violation of the given rule responsively to the measured locations.

There is further provided, in accordance with an embodiment that is described herein, a security system, including:

a Radio Frequency Identification (RFID) tag, which is attached to a boarding pass that is issued to a passenger entering a transportation terminal;

one or more RFID transceivers, which are coupled to measure a location of the RFID tag; and a processor, which is coupled to accept a definition of one or more rules specifying permitted movements of passengers in the terminal, to detect a violation of at least one of the rules performed by the passenger responsively to the measured location of the RFID tag, and to invoke an action with respect to the detected violation.

There is also provided, in accordance with an embodiment that is described herein, a security system, including:

a Radio Frequency Identification (RFID) tag, which is attached to a luggage item that is admitted by a passenger into a transportation terminal;

one or more RFID transceivers, which are coupled to measure a location of the RFID tag; and a processor, which is coupled to accept a definition of a rule specifying permitted movements of luggage items in the terminal, to detect a violation of the rule by the luggage item responsively to the measured location of the RFID tag, and to invoke an action with respect to the detected violation.

The present disclosure will be more fully understood from the following detailed description of the embodiments thereof, taken together with the drawings in which:

DETAILED DESCRIPTION OF EMBODIMENTS

Overview

Embodiments that are described herein provide methods and systems for detecting and acting upon security violations in an airport boarding area. The methods and systems described herein use RFID tags to track the locations of passengers' boarding passes and/or luggage tags throughout the boarding area and its surroundings, and detect potential security violations based on the tracked locations of the RFID tags.

In some embodiments, passengers checking-in at an airline counter are issued boarding passes fitted with RFID tags. Additionally or alternatively, passengers' hand-carried luggage items are marked with baggage tags fitted with RFID tags. The tags may be uploaded automatically with information regarding the passenger, the flight and/or the luggage item.

RFID transceivers are installed at selected, known locations around the boarding area and its surroundings. The RFID transceivers track the locations of the RFID tags and report their measurements to a security server. The security server applies one or more rules (also referred to as alert criteria) to the location measurements, so as to detect potential security violations. When detecting a violation of a rule that indicates a possible security violation, the server invokes appropriate action, such as sending an alert to an airport security center or to wireless terminals of security personnel.

The disclosed methods and systems can use various rules to detect various types of security violations and threats. Generally, the rules define forbidden and permitted movements of passengers and/or luggage items, such that violation of a rule is indicative of a potential security threat. For example, an alert can be triggered when a boarding pass RFID tag is located in a restricted area. As another example, a boarding pass RFID tag that is stationary for a long period of time in an area in which it is expected to be in motion (e.g., in a transit corridor) may indicate a potential security threat. An RFID tag on a luggage item that remains stationary for a long period of time may also be a reason for concern, as it may be indicative of an unattended luggage item. Some criteria may depend on multiple RFID tags. For example, an alert can be triggered if a boarding pass and a baggage tag belonging to the same passenger, or two baggage tags belonging to the same passenger, are located in different areas.

The methods and systems described herein enhance the level of airport security. When using these methods and systems, potential security threats can be detected and acted upon rapidly and efficiently.

System Description

Figure 1:
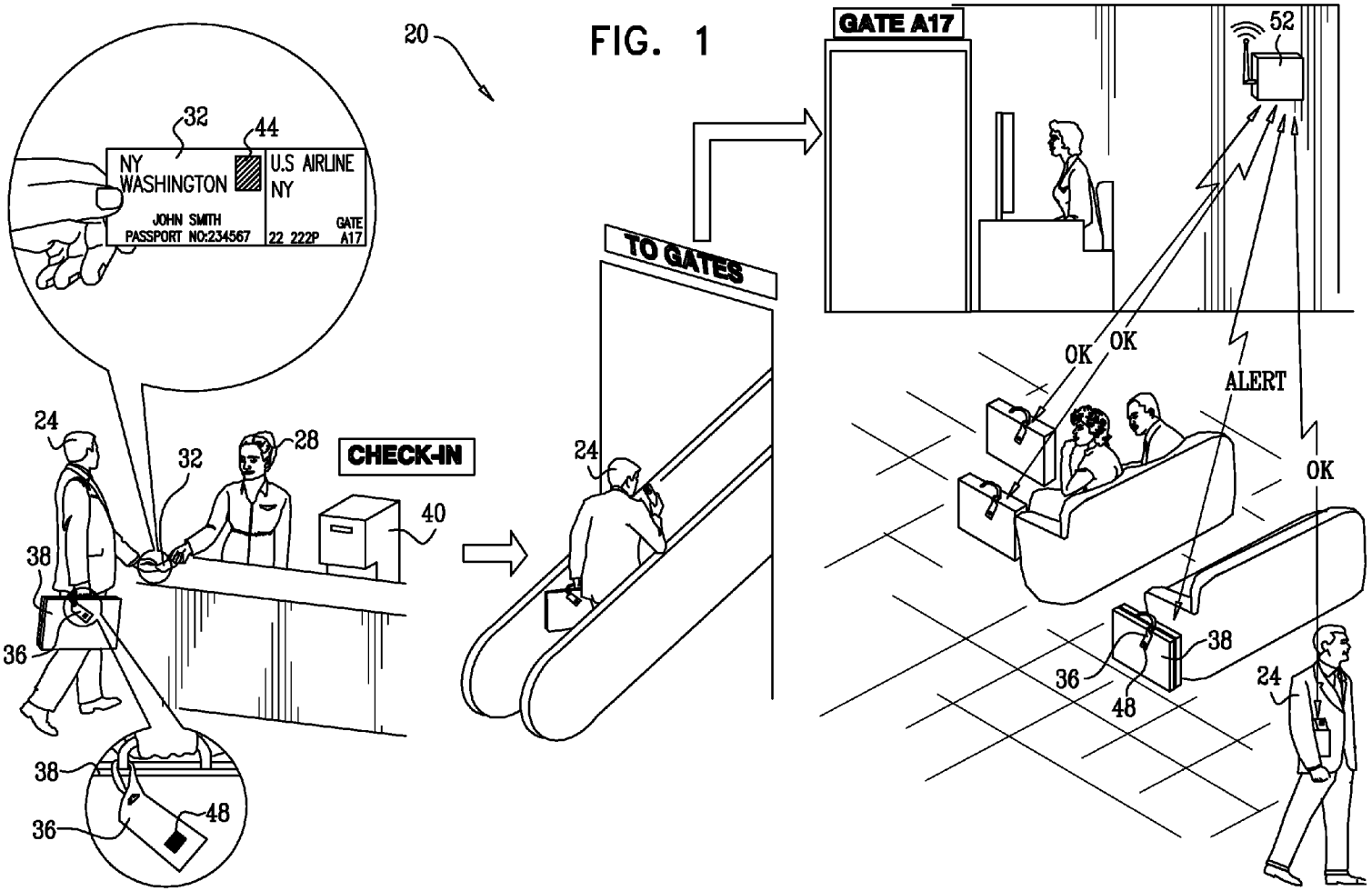
FIG. 1 is a schematic, pictorial illustration of a system for boarding area security in an airport, in accordance with an embodiment of the present disclosure.

FIG. 1 is a schematic, pictorial illustration of a system 20 for securing the boarding area of an airport, in accordance with an embodiment of the present disclosure. In the embodiment described herein, the system is deployed in an airport. In alternative embodiments, however, similar systems can be operated in other types of transportation terminals, such as seaports and land border terminals.

In the airport security application, a passenger 24 checks-in at an airline counter in order to board a flight. An airline representative 28 issues passenger 24 a boarding pass 32 and a baggage tag 36. Boarding pass 32 is handed to the passenger, and baggage tag 36 is attached to a luggage item that is hand-carried by the passenger, in the present example a briefcase 38. In the context of the present patent application and in the claims, terms such as "luggage item" and "hand-carried luggage item" refer to any item that remains in the passenger's possession for at least some of the time in the boarding area. Such items may comprise, for example, carry-on items that remain with the passenger during the flight, gate-checked items such as baby strollers, items acquired by the passenger in the terminal (e.g., duty-free items) and in some cases also checked-baggage items.

In some embodiments, boarding pass 32 comprises an RFID tag 44, which enables system 20 to detect and track the location of the boarding pass. Additionally or alternatively, baggage tag 36 that is attached to briefcase 38 may comprise an RFID tag 48, which enables system 20 to detect and track the tag's location. Each RFID tag typically comprises a memory, which stores an identifier that uniquely identifies the tag and possibly additional information related to the passenger or luggage item. System 20 detects security violations performed by passenger 24 and/or security violations related to briefcase 38 based on the tracked locations of RFID tags 44 and/or 48.

In some embodiments, the boarding passes and baggage tags are produced by a ticket printing unit 40. (The description that follows assumes that unit 40 produces both boarding passes and baggage tags. Alternatively, the boarding passes and baggage tags may be produced by two separate units.) In some embodiments, unit 40 uploads information into tags 44 and/or 48 during the check-in process. Such information may comprise, for example, the passenger's passport number, boarding pass details or any other suitable information regarding the passenger, the flight or the passenger's luggage. Unit 40 may also upload into the RFID tags information and comments regarding the passenger that are entered manually by airline representative 28.

In some embodiments, the airline representative performs the check-in process using a check-in computer terminal (not shown), which is connected to the airline's and/or airport's computer system. Unit 40 may be connected to this check-in computer terminal for obtaining some or all of the information that is uploaded into the RFID tags.

System 20 comprises multiple RFID transceivers 52, which are installed at different known locations in the airport. Each transceiver 52 is able to communicate with RFID tags in its vicinity, identify the tags, report them and possibly read the information stored in the tags. System 20 detects security violations related to passengers and/or baggage items based on the location measurements performed by transceivers 52, using methods that are described in detail below. When a security violation is detected, the system triggers an alert or invokes other appropriate action.

In the example of FIG. 1, an RFID transceiver 52 is shown installed at the gate area. The transceiver communicates with RFID tag 48 attached to baggage tag 36 of briefcase 38 in order to track the briefcase's location. Typically, the transceiver transmits an interrogation signal, and receives responses from RFID tags that are within communication range and are triggered by the interrogation signal. In the example of FIG. 1 the transceiver triggers four RFID tags in its vicinity—one fitted in a boarding pass and three fitted in baggage tags on luggage items.

Generally, transceivers 52 may be positioned at different locations in the boarding area, in or near sensitive or restricted areas, in or near the turf area of the airport (the open area between the terminal buildings and the runways), or in any other suitable locations in or around the airport.

Transceivers 52 may measure the locations of RFID tags 44 and 48 in various ways. Typically, each transceiver has a limited communication range, i.e., it is able to communicate with RFID tags that are located in a certain area-of-interest around the transceiver. In some embodiments, each transceiver produces indications as to the RFID tags with which it is able to communicate. Thus, when a given transceiver produces an indication regarding a certain RFID tag, system 20 concludes that the tag is located in the vicinity of this transceiver. The size of the area-of-interest around a given transceiver can be controlled, for example, by setting the transmission power of the transceiver. A typical range may be from several meters and up to 10-50 meters, as desired, although other ranges can also be used. In alternative embodiments, a given RFID tag can be detected by multiple transceivers, and the tag's location can be computed based on the indications produced by the multiple transceivers (e.g., by triangulation of three or more RFID transceivers).

Tags 44 and 48 may comprise any suitable type of RFID tags known in the art. For example, the tags may comprise passive tags that are powered exclusively by the energy of the transceiver's interrogation signal. Alternatively, the tags may comprise active tags, which comprise an internal power source that provides electrical power to the tag. Semi-active tags (also referred to as battery-assisted tags) can also be used. Semi-active tags typically comprise an internal power source that powers the digital circuitry (e.g., processor or memory) of the device, whereas transmission toward the transceiver is performed passively, by backscattering the transceiver's interrogation signal. A wide variety of RFID tags, RFID transceivers and communication techniques are known in the art, and any suitable solution can be used for implementing system 20.

FIG. 1 shows only a single check-in counter, a single transceiver, a single boarding pass and a small number of baggage tags, for the sake of clarity. In practical system implementation, however, system 20 comprises multiple check-in counters, multiple transceivers. Each transceiver may communicate with multiple boarding passes and baggage tags fitted with RFID tags simultaneously.

Figure 2:
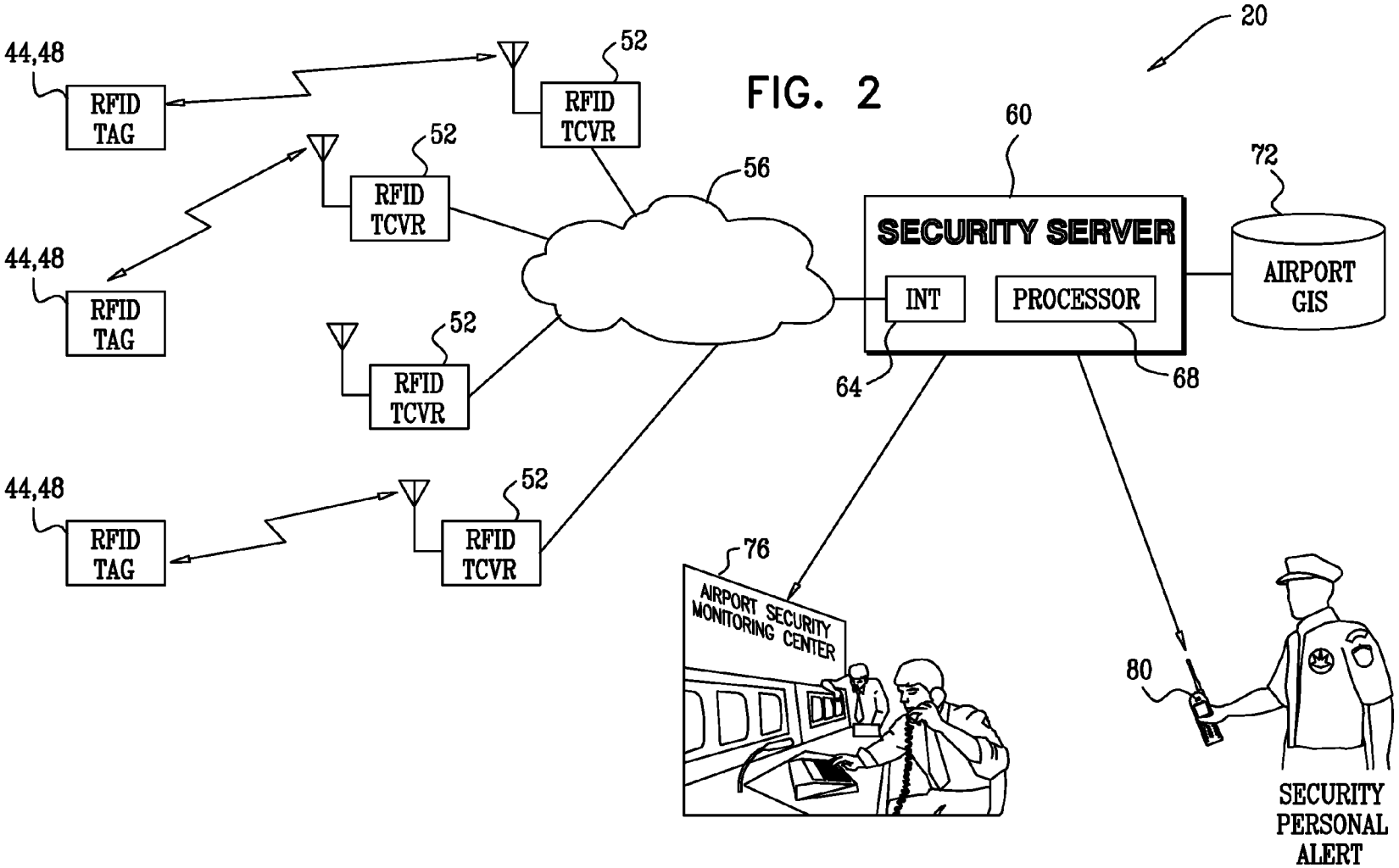
FIG. 2 is a block diagram that schematically illustrates a system for boarding area security, in accordance with an embodiment of the present disclosure.

FIG. 2 is a block diagram that schematically illustrates security system 20, in accordance with an embodiment of the present disclosure. As explained above, system 20 comprises multiple RFID transceivers 52 that communicate with tags 44 and 48. The RFID transceivers are connected via a communication connection 56 to a security server 60. Connection 56 may comprise a suitable communication network, a set of point-to-point connections, and/or any other suitable means for communicating between transceivers 52 and server 60.

Server 60 comprises an interface 64 for communicating with transceivers 52, and a processor 68 that carries out the methods described herein. In particular, processor 68 accepts the location measurements from transceivers 52 (e.g., indications of RFID tags detected by the transceivers), processes the measured locations of the different RFID tags in order to detect possible security violations, and invokes appropriate action upon detecting security violations. Server 60 may access an airport Geographic Information System (GIS), which provides the airport map and layout, and may provide clutter information of both outdoor and indoor locations around the airport. The clutter information can be used, for example, to enhance the accuracy of the location indications provided by the RFID transceivers.

In some embodiments, processor 68 produces alerts that are sent to an airport security monitoring center 76 and presented to an operator of the monitoring center, such as using a suitable display or other output device. Additionally or alternatively, the alerts can be sent to mobile communication terminals 80 of airport security personnel. The terminals may comprise, for example, mobile phones, radio transceivers, mobile computing devices such as Personal Digital Assistants (PDA), or any other sort of wireless communication terminal. Alerts can be sent to the terminals using recorded voice alerts, Short Message Service (SMS) alerts or any other suitable means. An alert regarding a given RFID tag may comprise some or all of the information that was uploaded into the tag and read by the transceiver.

In some embodiments, the functions of server 60 may be integrated on a certain computing platform together with other airport security functions. Alternatively, the functions of sever 60 can be carried out by an independent computing platform. Typically, processor 68 comprises a general-purpose computer, which is programmed in software to carry out the functions described herein. The software may be downloaded to the computer in electronic form, over a network, for example, or it may, alternatively or additionally, be provided and/or stored on tangible media, such as magnetic, optical, or electronic memory.

Detecting Security Violations Based on RFID Tag Location

In some embodiments, processor 68 uses a predefined set of rules, which define permitted/forbidden movements of passengers and/or luggage items, such that a violation of at least one of the rules indicates a potential security violation. The term "movement" refers to any location characteristic related to the passengers and/or luggage items, such as position and change of position (e.g., stationary vs. non-stationary behavior).

The processor may apply any suitable rules for detecting possible security violations based on the measured locations of the RFID tags attached to boarding passes and hand-luggage items.

For example, processor 68 may trigger an alert if an RFID tag is detected in an area that is restricted for passengers, e.g., in the turf area or a personnel-only zone. Typically, a transceiver 52 will be installed in such a restricted area for detecting unauthorized presence of passengers or luggage items in the area.

As another example, an RFID tag that is stationary for a long period of time may be a reason for concern. A stationary RFID tag fitted in a baggage tag may indicate an unattended luggage item that was left behind, intentionally or unintentionally. A boarding pass RFID tag, which remains stationary for a long period of time, may indicate a passenger who does not transit through the boarding area en-route to his or her flight as expected, and may thus indicate a security risk.

Each alert is created based on a detection of a restricted or unauthorized location of an RFID tag. In case of alert, additional means can be operated for verification and further detection, e.g., video surveillance and/or manned surveillance. Some rules may apply in some locations but not in others. For example, an RFID tag that remains stationary for a long period of time in the gate area can be regarded as abnormal and trigger alert. A stationary RFID tag in a transit corridor or in the restroom area may also be a reason for triggering an alert.

Some rules may apply jointly to multiple RFID tags. For example, processor 68 may issue an alert if the boarding pass of a given passenger is detected in a certain area, but a luggage item of the same passenger is detected in a different area. An alert can also be triggered if two baggage tags belonging to the same passenger are found in different areas.

Note that the methods and systems described herein can be implemented equivalently using the opposite logic, in which a rule is met when the passenger or luggage item exhibits forbidden movement. Although the embodiments described herein refer to rule violation, the opposite logic is regarded as equivalent.

Security Method Description

Figure 3:
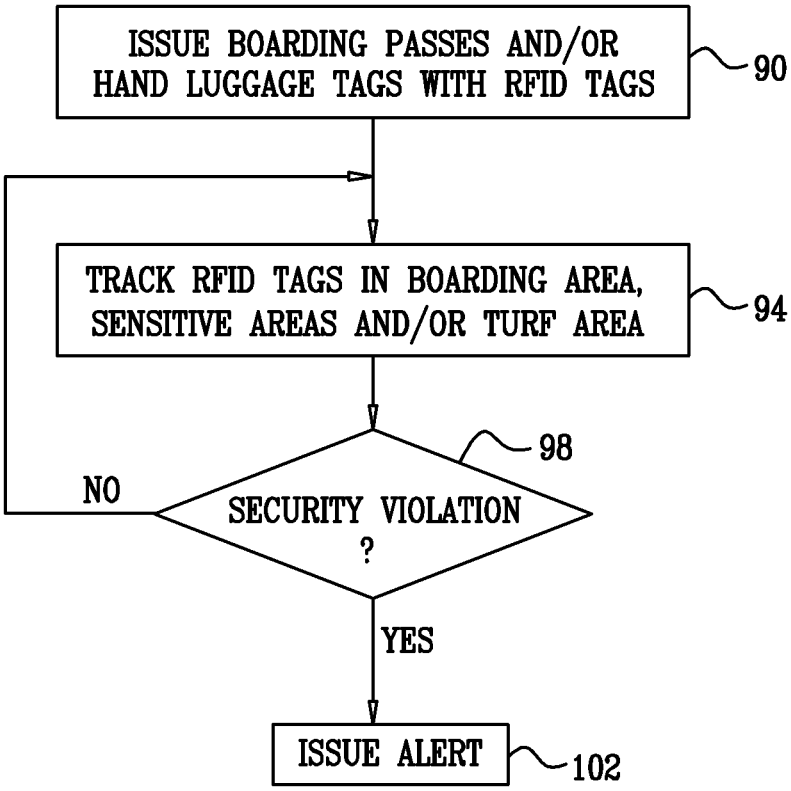
FIG. 3 is a flow chart that schematically illustrates a method for boarding area security, in accordance with an embodiment of the present disclosure.

FIG. 3 is a flow chart that schematically illustrates a method for boarding area security, in accordance with an embodiment of the present disclosure. The method begins with airline representative 28 issuing boarding passes and/or hand-luggage tags having RFID tags attached thereto, at an issuing step 90. The RFID tags are issued and uploaded with information regarding the passenger or luggage, as explained above.

Transceivers 52 track the RFID tags of the boarding passes and/or baggage tags throughout the boarding area, turf area and/or other sensitive areas, at a tracking step 94. Each transceiver reports the RFID tags it is able to interrogate to server 60. Processor 68 of server 60 accepts the reports (or other form of location measurements) from the different transceivers, and applies the appropriate alert criteria to the measurements in order to detect possible security violations.

The processor checks whether a security violation is detected with respect to a passenger or luggage item, at a checking step 98. In some embodiments, the processor applies one or more predefined rules that define permitted movements of passengers and/or luggage items to the reported locations of the RFID tags. If no security violation is detected (i.e., if no rule is violated), the method loops back to step 94 above, and system 20 continues to track the different RFID tags. If, on the other hand, a security violation (i.e., rule violation) is detected, processor 68 invokes appropriate action, at an action invocation step 102. For example, the processor may issue an alert to monitoring center 76 and/or mobile terminals 80.

Method steps 90-102 can be applied in different orders. For example, in a typical airport application, the check-in process (step 90) continues when some passengers and luggage items are already tracked in the boarding area (step 94). From the perspective of server 60, new RFID tags may appear at any time during operation, as additional passengers check-in. Moreover, the rules used for detecting security violations may be modified at any time.

In addition to providing security measures, system 20 can also be used for tracking passengers who are late in arriving at the departure gate. By tracking the RFID tags on boarding passes and/or hand-carried luggage items, system 20 can determine the location of a late-arriving passenger, and direct airline staff to the passenger in order to guide him to the gate. System 20 can also assist in finding lost or misplaced luggage items and boarding passes.

In some embodiments, system 20 can be distributed over two or more airports, for example in order to apply the disclosed methods to passengers in transit, to address passengers arriving on flights and passing through the terminal, or to secure the arrivals area of the airport. For a given passenger or baggage item, the airports may comprise the airport of origin, one or more airports in transit and/or the destination airport. In these scenarios, a passenger is issued a boarding pass or luggage tag fitted with an RFID tag at one airport, and then flies to a second airport, perhaps via one or more other airports. System 20 may track the location of the passenger's RFID tag at any of these airports in order to detect possible security threats. Such implementations are likely to involve international standardization of RFID-based security measures. Moreover, the methods and systems described herein can be applied on-board an airplane, in order to track passenger behavior or location inside the airplane. On-board tracking can be performed before, after or even during the flight.

The embodiments described herein refer to boarding passes and baggage tags. The methods and systems described herein can be used, however, with various other kinds of documents or other means that are used to mark or identify passengers and luggage items in the boarding area or other areas of interest. For example, an RFID tag can be attached to a luggage items using a sticker or using any other means. Additionally or alternatively, an RFID tag can be attached to a passenger's airline ticket, passport or other document.

Although the embodiments described herein refer to airport security, the methods and systems described herein can be applied for securing other transportation terminals in which passengers are issued tickets or passes, such as seaports, border crossing terminals, train stations and bus terminals.

It will thus be appreciated that the embodiments described above are cited by way of example, and that the present disclosure is not limited to what has been particularly shown and described hereinabove. Rather, the scope of the present disclosure includes both combinations and sub-combinations of the various features described hereinabove, as well as variations and modifications thereof which would occur to persons skilled in the art upon reading the foregoing description and which are not disclosed in the prior art.

The invention claimed is:

1. A security method, comprising:

defining one or more rules specifying permitted movements of passengers in a transportation terminal;

issuing to a passenger entering the terminal a boarding pass having a Radio Frequency Identification (RFID) tag attached thereto;

measuring a location of the RFID tag by using a transceiver, wherein the transceiver can detect the RFID signal from several meters or more;

responsively to the measured location of the RFID tag, detecting a violation of at least one of the rules performed by the passenger; and invoking an action with respect to the detected violation, wherein at least one of the rules specifies a region in which the passengers are expected to be in motion, and wherein detecting the violation comprises detecting that the passenger is located in the specified region but is not in motion, and wherein issuing the boarding pass comprises uploading information regarding the passenger into the RFID tag, wherein measuring the location comprises extracting the uploaded information from the RFID tag through the transceiver.

2. The method according to claim 1, wherein at least one of the rules specifies a region that is forbidden for access, and wherein detecting the violation comprises detecting that the passenger is located in the specified region.

3. The method according to claim 1, wherein at least one of the rules specifies a region in which the passengers are expected not to be stationary for more than a given time period, and wherein detecting the violation comprises detecting that the passenger is stationary in the specified region for longer than the given time period.

4. The method according to claim 1, wherein the transportation terminal comprises at least first and second separate terminals, wherein issuing the boarding pass comprises issuing the boarding pass at the first terminal, and wherein measuring the location comprises measuring the location of the RFID tag at the second terminal.

5. The method according to claim 1, wherein invoking the action comprises issuing an alert.

6. The method according to claim 5, wherein issuing the alert comprises reporting at least part of the extracted information in the alert.

7. The method according to claim 5, wherein issuing the alert comprises providing the alert to a monitoring center.

8. The method according to claim 5, wherein issuing the alert comprises transmitting the alert to a wireless communication terminal.

9. The method according to claim 1, wherein issuing the boarding pass comprises attaching another RFID tag to a luggage item that is admitted by the passenger into the terminal, wherein measuring the location comprises measuring a first location of the RFID tag and a second location of the other RFID tag, and wherein detecting the violation comprises detecting a mismatch between the first and second locations.

10. A security method, comprising:

defining a rule specifying permitted movements of luggage items in a transportation terminal;

attaching a Radio Frequency Identification (RFID) tag to a luggage item that is admitted by a passenger into the terminal;

measuring a location of the RFID tag by using a transceiver, wherein the transceiver can detect the RFID signal from several meters or more;

responsively to the measured location of the RFID tag, detecting a violation of the rule by the luggage item; and invoking an action with respect to the detected violation, wherein at least one rule specifies a region in which a luggage item is expected to be in motion, and wherein the processor is coupled to detect that a luggage time is located in the specified region but is not in motion, and wherein information regarding the passenger is uploaded into the RFID tag, wherein measuring the location comprises extracting the uploaded information from the RFID tag through the transceiver.

11. The method according to claim 10, wherein at least one of the rules specifies a region in which the luggage items are expected not to be stationary for more than a given time period, and wherein detecting the violation comprises detecting that the luggage item is stationary in the specified region for longer than the given time period.

12. The method according to claim 10, wherein a given rule specifies permitted relations between the movements of multiple luggage items, wherein attaching the RFID tag comprises attaching two or more RFID tags to respective luggage items admitted into the terminal, wherein measuring the location comprises measuring respective locations of the RFID tags, and wherein detecting the violation comprises detecting the violation of the given rule responsively to the measured locations.

13. A security system, comprising:

a Radio Frequency Identification (RFID) tag, which is attached to a boarding pass that is issued to a passenger entering a transportation terminal;

one or more RFID transceivers, which are coupled to measure a location of the RFID tag, wherein the transceiver can detect the RFID signal from several meters or more; and a processor, which is coupled to accept a definition of one or more rules specifying permitted movements of passengers in the terminal, to detect a violation of at least one of the rules performed by the passenger responsively to the measured location of the RFID tag, and to invoke an action with respect to the detected violation, wherein at least one of the rules specifies a region in which the passengers are expected to be in motion, and wherein the processor is coupled to detect that the passenger is located in the specified region but is not in motion, and wherein the boarding pass comprises uploaded information regarding the passenger into the RFID tag, wherein measuring the location comprises extracting the uploaded information from the RFID tag through the transceiver.

14. The system according to claim 13, wherein at least one of the rules specifies a region that is forbidden for access, and wherein the processor is coupled to detect that the passenger is located in the specified region.

15. The system according to claim 13, wherein at least one of the rules specifies a region in which the passengers are expected not to be stationary for more than a given time period, and wherein the processor is coupled to detect that the passenger is stationary in the specified region for longer than the given time period.

16. The system according to claim 13, wherein the transportation terminal comprises at least first and second separate terminals, wherein the boarding pass is issued at the first terminal, and wherein the RFID transceivers are coupled to measure the location of the RFID tag at the second terminal.

17. The system according to claim 13, wherein the processor is coupled to invoke the action by issuing an alert.

18. The system according to claim 17, wherein the processor is coupled to report at least part of the extracted information in the alert.

* * * * *